US010428430B2

(12) United States Patent
Moghbeli

(10) Patent No.: US 10,428,430 B2
(45) Date of Patent: Oct. 1, 2019

(54) MARINE UTILITY CAST IRON ANODE

(71) Applicant: Omidreza Moghbeli, Rancho Cucamonga, CA (US)

(72) Inventor: Omidreza Moghbeli, Rancho Cucamonga, CA (US)

( * ) Notice: Subject to any disclaimer, the term of this patent is extended or adjusted under 35 U.S.C. 154(b) by 133 days.

(21) Appl. No.: 15/696,350

(22) Filed: Sep. 6, 2017

(65) Prior Publication Data

US 2018/0066368 A1 Mar. 8, 2018

Related U.S. Application Data

(60) Provisional application No. 62/384,042, filed on Sep. 6, 2016.

(51) Int. Cl.

| | |
|---|---|
| ***C23F 13/18*** | (2006.01) |
| ***C23F 13/06*** | (2006.01) |
| ***C23F 13/08*** | (2006.01) |
| ***C23F 13/10*** | (2006.01) |
| ***C23F 13/20*** | (2006.01) |

(52) U.S. Cl.
CPC ..... *C23F 13/10* (2013.01); *C23F 13/20* (2013.01); *C23F 2213/31* (2013.01)

(58) Field of Classification Search
CPC ..... C23F 13/18; C23F 13/10; C23F 2213/31; C23F 13/06; C23F 13/16; C23F 13/08; C23F 13/005
USPC ..... 204/196.17
See application file for complete search history.

(56) References Cited

U.S. PATENT DOCUMENTS

| | | | | |
|---|---|---|---|---|
| 7,425,249 | B1 | 9/2008 | Britton | |
| 8,721,848 | B1 * | 5/2014 | Simpson | C23F 13/18 204/196.01 |
| 2008/0105562 | A1 | 5/2008 | Simpson et al. | |
| 2011/0089048 | A1 * | 4/2011 | Nelvig | C23F 13/04 205/730 |
| 2011/0100802 | A1 * | 5/2011 | Georgia | C23F 13/16 204/196.38 |

* cited by examiner

*Primary Examiner* — Zulmariam Mendez
(74) *Attorney, Agent, or Firm* — Averill & Green; Kenneth L. Green

(57) ABSTRACT

An improved marine anode sled comprises a single piece casting with high surface to weight ratio providing increased active surfaces and improved reliability. In one embodiment the anode weighs about 2,000 lbs and has an active surface area of about 5,000 square inches and a current output capacity of up to 160 amps. The improved anode has considerably higher current output than existing anode sleds with similar weight. Unlike known anode sleds, the entire exposed surface of new anode sled is anode material and passes current to a surrounding medium. The single piece casting eliminates structural failure when a frame of know anode sleds is damaged, and electrical failure when cables connecting multiple anodes are damaged. Two redundant lead cable are attached proximal to opposite corners to optimize reliability and electrical performance.

20 Claims, 3 Drawing Sheets

MARINE UTILITY CAST IRON ANODE

CROSS-REFERENCE TO RELATED APPLICATIONS

The present application claims the priority of U.S. Provisional Patent Application Ser. No. 62/384,042 filed Sep. 6, 2016, which application is incorporated in its entirety herein by reference.

BACKGROUND OF THE INVENTION

The present invention relates generally to anodes being utilized in impressed current cathodic protection system of marine submerged pipelines and structures.

Submerged metallic surfaces of pipelines and other structures in marine environment are subject to corrosion due to electrochemical reactions between the metallic surfaces and seawater they are in contact with. Cathodic protection systems are installed to limit the amount of corrosion occurring on the subjected surfaces. Impressed current cathodic protection systems are excessively used in marine environment employ a series of anodes at the sea or ocean bottom in order to mitigate and control the severity of corrosion attacks. One of the most common anode materials used in impressed current cathodic protection systems of marine structures is high silicon cast iron.

The existing impressed current cathodic protection anodes are commonly produced in the shape of simple rod or tube using sand molded casting or metal die casting techniques. Because of ocean currents and pump-jet streams from ships, especially in near piers and coast zones, the anode systems are exposed to strong forces. When submerged, the effective weight of anode system is reduced significantly in compared with onshore condition. As a result, the submerged anode system placed at the ocean or sea floor must be heavy enough to prevent any movement and subsequent failure.

Known anode systems utilize an anode sled assembly having a number of conventional cylindrical or tubular cast iron cathodic protection anodes commonly used in underground applications, attached to a frame generally made of concrete. The frame typically includes two large diameter concrete longitudinal beams connected by smaller lateral beams. The anode sled assembly includes four lifting eyes, one or two electrical cable connections for each cathodic protection anode, anode clamps to attach the cathodic protection anodes to sled, and cables to connect the anode sled to a current source. Damage to any of the cables or clamps can result in failure of the anode sled. Current output capacity and efficiency of each cathodic protection anode in a specific medium is limited by the surface area of the anode.

BRIEF SUMMARY OF THE INVENTION

The present invention addresses the above and other needs by providing an improved marine anode sled comprises a single piece casting with high surface to weight ratio providing increased active surfaces and improved reliability. In one embodiment the anode weighs about 2,000 lbs and has an active surface area of about 5,000 square inches and a current output capacity of up to 160 amps. The improved anode has considerably higher current output than existing anode sleds with similar weight. Unlike known anode sleds, the entire exposed surface of new anode sled is anode material and passes current to a surrounding medium. The single piece casting eliminates structural failure when a frame of known anode sleds is damaged, and electrical failure when cables connecting multiple anodes are damaged. Two redundant lead cable are attached proximal to opposite corners to optimize reliability and electrical performance.

In accordance with one aspect of the invention, there is provided a single piece cast marine utility anode comprising longitudinal three beams attached to two lateral beams at ends of the longitudinal beams. The longitudinal beams are spaced above a floor the marine utility anode rests on providing increased exposed active surface area to improve output current. At least one lead is attached to the marine utility anode providing positive direct current, and preferably two redundant leads are attached to opposite corners of the marine utility anode, both providing positive direct current.

In accordance with another aspect of the invention, there is provided a anode system including the anode sled and a rectifier mounted to a deck supported by pilings. Cables connect a positive terminal of the rectifier to the anode sleds through a junction. A negative terminal of the rectifier is connected to the pilings or other suitable ground, by the cables. The anode sleds rest on the floor submerged in water.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
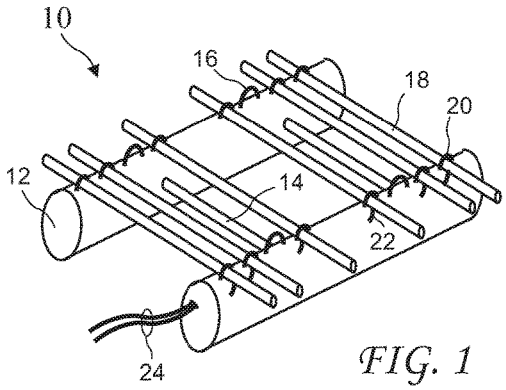
FIG. 1 (prior art)
FIG. 1 shows a prior art marine anode sled.

A prior art marine anode sled 10 is shown in FIG. 1. The anode sled 10 includes a frame comprising two large diameter concrete longitudinal beams 12 connected by smaller lateral beams 14, and four lifting eyes 16. A plurality of anodes 18 are attached to the beams 12 by loops 20. One or two electrical cable connections 22 connect to each cathodic protection anode 18, anode clamps 20 attach the cathodic protection anodes 18 to frame, and cables 24 to connected the anode sled 10 to a current source. Damage to any of the cables or clamps can result in failure of the anode sled 10.

Figure 2A:
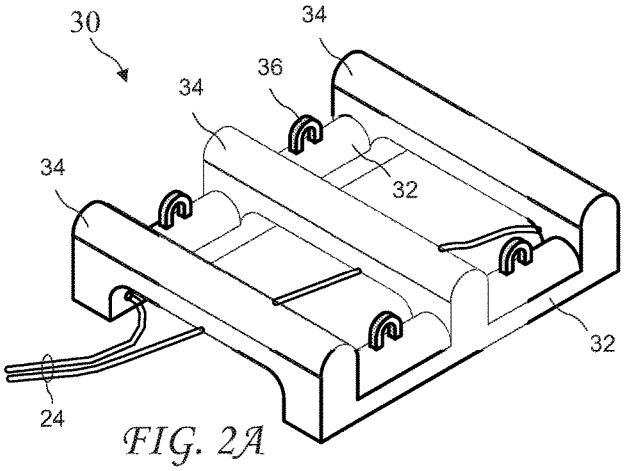
FIG. 2A shows an isometric view of an improved marine anode sled having lifting eyes according to the present invention.

An isometric view of an improved marine anode sled 30 according to the present invention is shown in FIG. 2A. The anode sled 30 includes at least two generally parallel lateral members 32 having lateral member centerlines CL1 (see FIG. 3A) and made of an anodic material and at least two generally parallel longitudinal members 34 attached to reside generally perpendicular to the lateral members and having longitudinal member centerlines CL2. The lateral members 32 are intended to rest on a floor 122 (see FIG. 4) of a body of water. The longitudinal members 34 reside at least partially above the lateral members 32 and are raised above the floor 122 so that the longitudinal members 34 are substantially (other than where the longitudinal members 34 contact the lateral members 32) surrounded by water. Lifting eyes 36 are cast into to the lateral members 32, but may be attached to the longitudinal members 34, and lifting holes 37 may replace the lifting eyes. At least one cable 24 is attached to the anode sled 30, and preferably two redundant cables 24 at attached in two separated locations to the anode sled 30. The two separated locations are preferably proximal to opposite corners.

Figure 2B:
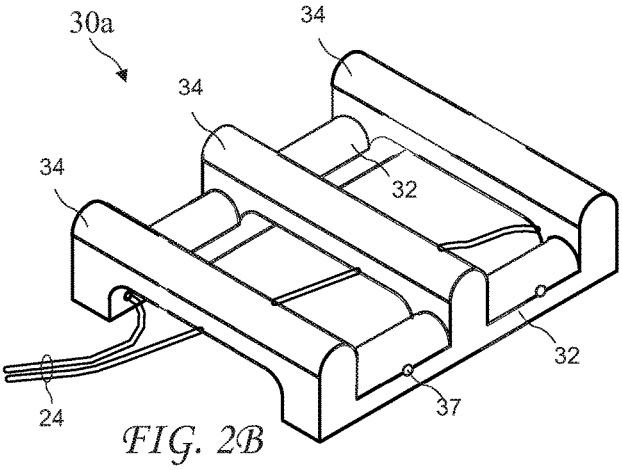
FIG. 2B shows an isometric view of a second improved marine anode sled having lifting holes according to the present invention.

An isometric view of an improved marine anode sled 30*a* is shown in FIG. 2B. The anode sled 30*a* replaces the lifting eyes 36 with lifting holes 37, and is otherwise similar to the anode sled 30.

Figure 3B:
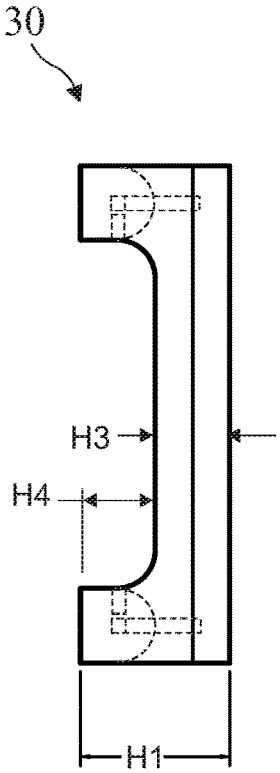
FIG. 3B shows a side view of the improved marine anode sled according to the present invention.
Figure 3A:
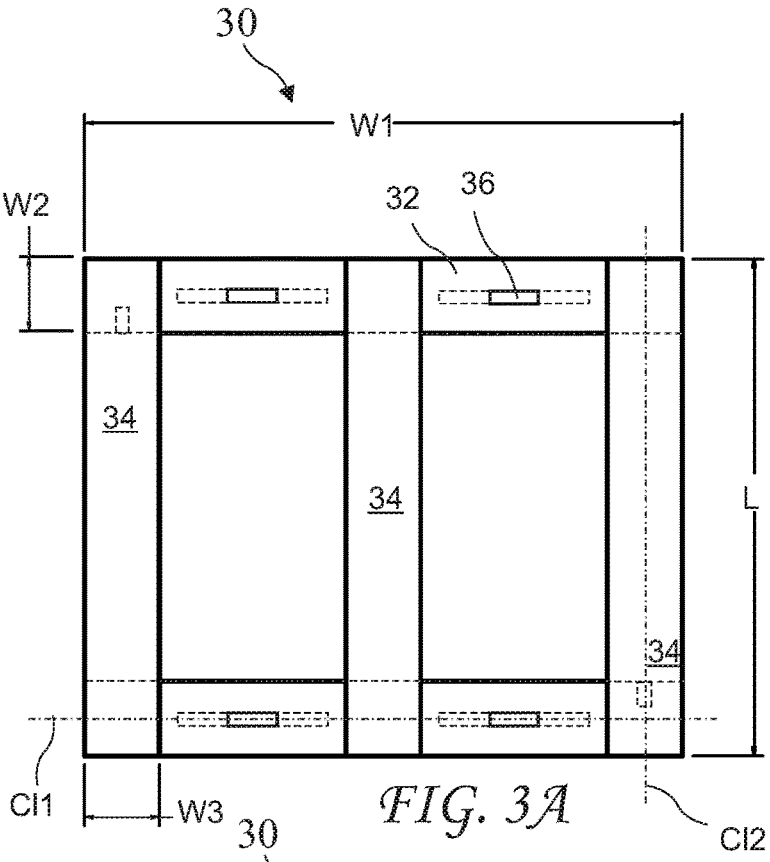
FIG. 3A shows a top view of the improved marine anode sled according to the present invention.
Figure 3C:
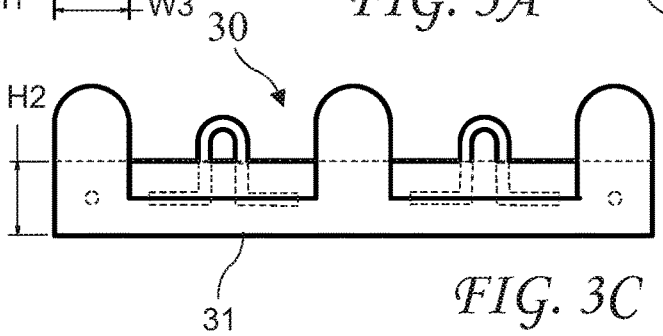
FIG. 3C shows a front view of the improved marine anode sled according to the present invention.

A top view of the anode sled 30 is shown in FIG. 3A, a side view of the anode sled 30 is shown in FIG. 3B, and a front view of the anode sled 30 is shown in FIG. 3C. In one embodiment, the anode sled 30 has an overall width W1, an overall length L, and an overall height H1. The width W1 is preferably about 48 inches, the length L1 is preferably about 40 inches, and the height H1 is preferably about 12 inches. The lateral members 32 have a width W2 and a height H2. The width W2 is preferably about six inches and the height H2 is preferably about six inches. The longitudinal members 34 have a width W3 and a height H3, and are supported by the lateral members 32 to reside a height H4 above the floor 122. The width W3 is preferably about six inches, the height H3 is preferably about six inches and the height H4 is preferably about six inches. The anode sleds 30 and 30*a* are configured to reside the floor 122 of body of water 126 on bottom surfaces 31 of the lateral members 31 and support the longitudinal members 34 entirely above the floor 122.

Figure 4:
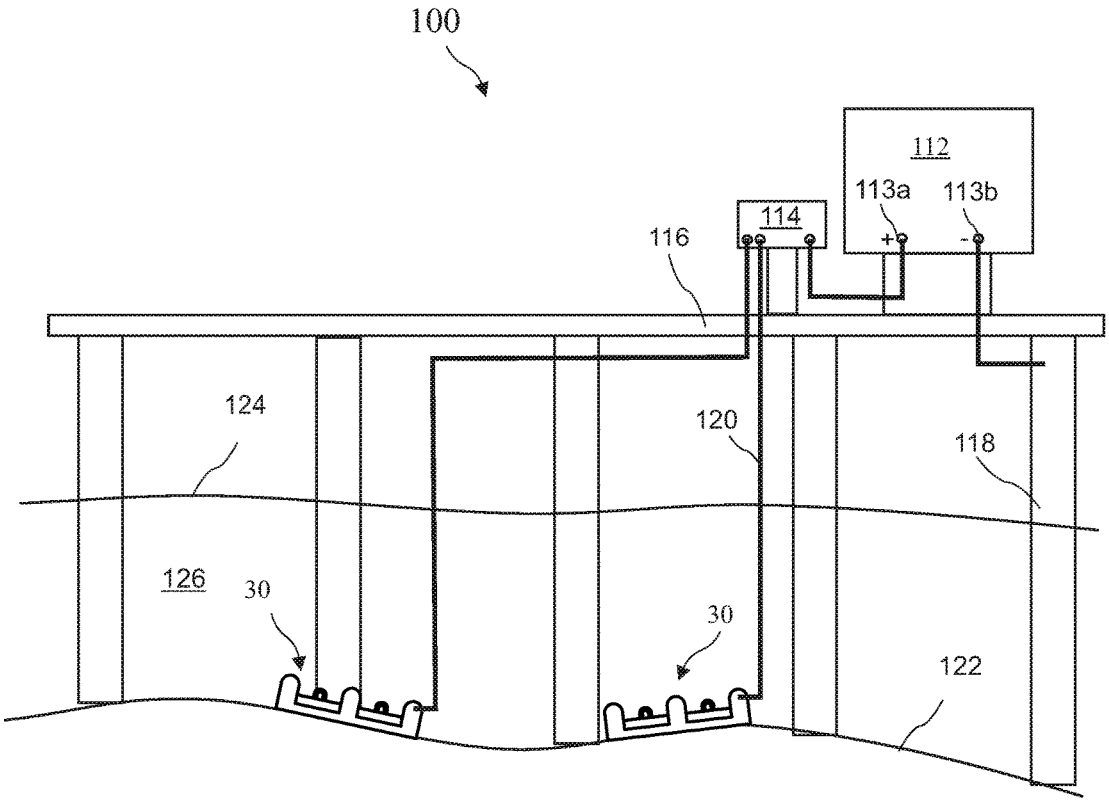
FIG. 4 shows a anode system including the improved marine anode sled according to the present invention.

An anode system 100 including the anode sled 30 is shown in FIG. 4. The anode system 100 includes a rectifier 112 mounted to a deck 116 supported by pilings 118. Cables 120 connect a positive terminal 113*a* of the rectifier 112 to the anode sleds 30 through a junction 114. A negative terminal 113*b* of the rectifier 112 is connected to the pilings 118 or other protected structure, by the cables 120. The anode sleds 30 rest on the floor 122 submerged in water 126 and below a water line 124.

The anode sleds 30 and 30*a* may be cast of an anodic material selected from alloys of iron, magnesium, aluminum, and zinc, and preferred anodic material is high silicon iron comprising silicon 14.20-14.75 percent by weight, manganese 1.5 maximum percent by weight, carbon 0.7-1.10 percent by weight, chromium 3.25-5.00 percent by weight, molybdenum 0.2 maximum percent by weight, copper 0.5 maximum percent by weight, and the remainder iron. In one embodiment, the anode sleds 30 and 30*a* have a total weigh of about 2,000 lbs. and active surface area of about 5000 sq. inches, and a current output capacity of up to 160 amps in sea water.

While the invention herein disclosed has been described by means of specific embodiments and applications thereof, numerous modifications and variations could be made thereto by those skilled in the art without departing from the scope of the invention set forth in the claims.

I claim:

1. A marine utility anode sled, comprising:

at least two generally parallel lateral members having lateral member centerlines and made of an anodic material;

at least two generally parallel longitudinal members attached to reside generally perpendicular to the lateral members and having longitudinal member centerlines above the lateral member centerlines of the lateral members and made of an anodic material; and at least one electrical cable in electrical communication with the anodic material of both the lateral members and longitudinal members.

2. The marine utility anode sled of claim 1, wherein the anode sled consisting essentially of high silicon cast iron material.

3. The marine utility anode sled of claim 1, wherein the anode sled is a single piece casting.

4. The marine utility anode sled of claim 1, wherein the at least two generally parallel longitudinal members comprise at least two generally parallel longitudinal member attached to reside generally perpendicular to the at least two generally parallel lateral members and having longitudinal member centerlines above the lateral member centerlines of the lateral members and made of an anodic material.

5. The marine utility anode sled of claim 4, wherein the anode sled is configured to rest on a floor of a body of water supported by bottom surfaces of the lateral member, and the entire longitudinal members are supported to reside above the floor.

6. The marine utility anode sled of claim 1, wherein the at least one cable comprises two cables redundantly, electrically connected to the anodic material of both the lateral members and longitudinal members.

7. A marine utility anode sled, comprising:

a single piece casting consisting essentially of a high silicon iron alloy; two generally parallel lateral members having lateral member centerlines;

three generally parallel longitudinal members attached to reside generally perpendicular to the lateral members and having longitudinal member centerlines above the lateral member centerlines of the lateral members;

two cables electrically connected to the anodic material of both the lateral members and longitudinal members; and the anode sled configured to rest on a floor of a body of water supported by bottom surfaces of the lateral members, the longitudinal members spaced vertically above the floor.

8. A marine anode system, comprising:

a rectifier residing on a deck above a body of water;

at least one anode sled comprising:

a single piece casting consisting essentially of a high silicon iron alloy;

two generally parallel lateral members having lateral member centerlines;

three generally parallel longitudinal members attached to reside generally perpendicular to the lateral members and having longitudinal member centerlines above the lateral member centerlines of the lateral members;

two cables electrically connected to the anodic material of both the lateral members and longitudinal members; and the anode sled configured to rest on a floor of a body of water supported by bottom surfaces of the lateral members, the longitudinal members spaced vertically above the floor; and the cables redundantly electrically connecting between the anode sled and a positive terminal of the rectifier.

9. The marine utility anode sled of claim 1, wherein least one electrical cable electrically connects the at least one anode sled to a rectifier residing on a deck above a body of water.

10. The marine utility anode sled of claim 1, wherein the entire exposed surface of the anode sled is anode material and passes current to a surrounding medium.

11. The marine utility anode sled of claim 1, wherein the at least two generally parallel lateral members have generally flat bottoms.

12. The marine utility anode sled of claim 11, wherein the at least two generally parallel longitudinal members have rounded tops.

13. The marine utility anode sled of claim 1, wherein the at least two generally parallel lateral members and the at least two generally parallel longitudinal members have heights of about six inches.

14. The marine utility anode sled of claim 1, wherein the at least two generally parallel lateral members have lengths of about 48 inches and the at least two generally parallel longitudinal members have lengths of about 40 inches.

15. The marine utility anode sled of claim 1, wherein:

the at least two generally parallel lateral members have lengths of about 48 inches and the at least two generally parallel longitudinal members have lengths of about 40 inches;

the at least two generally parallel lateral members and the at least two generally parallel longitudinal members have heights and widths of about six inches.

16. The marine utility anode sled of claim 1, wherein a horizontal projection of an overlapping connection of the at least two generally parallel lateral members and the at least two generally parallel longitudinal members is about six by six inches.

17. The marine utility anode sled of claim 1, wherein bottom of the at least two generally parallel longitudinal members are about even with tops of the at least two generally parallel lateral members.

18. The marine utility anode sled of claim 1, wherein bottoms of the at least two generally parallel longitudinal members are about six inches above bottoms of the at least two generally parallel lateral members.

19. The marine utility anode sled of claim 1, wherein:

the anode sled is a single piece casting; and the entire exposed surface of the anode sled is anode material and passes current to a surrounding medium.

20. The marine utility anode sled of claim 1, wherein:

the anode sled is a single piece casting;

the entire exposed surface of the anode sled is anode material and passes current to a surrounding medium;

the at least two generally parallel lateral members comprise two lateral members having lengths of about 48 inches;

the at least two generally parallel longitudinal members comprise three generally parallel longitudinal members having lengths of about 40 inches;

the two generally parallel lateral members and the three generally parallel longitudinal members have heights and widths of about six inches;

a horizontal projection of an overlapping connection of the at least two generally parallel lateral members and the at least two generally parallel longitudinal members is about six by six inches;

the two lateral members have flat bottom; and bottoms of the at least two generally parallel longitudinal members are about six inches above bottoms of the at least two generally parallel lateral members.

* * * * *